United States Patent [19]

Yamazaki et al.

[11] Patent Number: 4,762,778

[45] Date of Patent: Aug. 9, 1988

[54] SILVER HALIDE PHOTOGRAPHIC LIGHT SENSITIVE MATERIAL

[75] Inventors: Katsumasa Yamazaki, Hachioji; Toshihiko Yagi, Kanagawa; Kenji Michiue; Sohei Goto, both of Hino; Yoshiharu Mochizuki, Hachioji, all of Japan

[73] Assignee: Konishiroku Photo Industry Co., Ltd., Tokyo, Japan

[21] Appl. No.: 62,343

[22] Filed: Jun. 10, 1987

Related U.S. Application Data

[63] Continuation of Ser. No. 680,281, Dec. 7, 1984, abandoned.

[30] Foreign Application Priority Data

Dec. 8, 1983 [JP] Japan ..... 58-231913

[51] Int. Cl.[4] ..... G03C 1/02; G03C 1/06

[52] U.S. Cl. ..... 430/567; 430/544; 430/957; 430/505

[58] Field of Search ..... 430/567, 544, 957, 505

[56] References Cited

U.S. PATENT DOCUMENTS

| | | | |
|---|---|---|---|
| 3,206,313 | 9/1965 | Porter et al. | 430/567 |
| 3,317,322 | 5/1967 | Porter et al. | 430/567 |
| 4,444,877 | 4/1984 | Koitabashi et al. | 430/567 |
| 4,461,826 | 7/1984 | Yamashita et al. | 430/957 |
| 4,477,564 | 10/1984 | Cellone et al. | 430/567 |

*Primary Examiner*—Won H. Louie

*Attorney, Agent, or Firm*—Finnegan, Henderson, Farabow, Garrett & Dunner

[57] ABSTRACT

A silver halide color photographic light-sensitive material has a support and at least one silver halide emulsion layer. At least one of the silver halide emulsion layers has a group of substantially monodisperse core/shell type silver halide grains having a value of not greater than 0.15. This value is obtained by dividing a standard deviation value by the average grain size value. The substantially monodisperse core/shell-type silver halide grains have shells from 0.01 to 0.1 in thickness. The silver halide grains include a silver iodide in the core in an amount of less than 8 mole % and a silver iodide in the shell of from 0.1 mole % to 6 mole %. A development inhibitor releasing compound having a relative development inhibitability of not less than 1 is also present in the emulsion layer.

3 Claims, No Drawings

SILVER HALIDE PHOTOGRAPHIC LIGHT SENSITIVE MATERIAL

This application is a continuation of application Ser. No. 680281 filed Dec. 7, 1984 abandoned.

BACKGROUND OF THE INVENTION

1. Field of the Invention

The present invention relates to a silver halide color light-sensitive material, and more particularly to the improvement of the silver halide light-sensitive material on its photographic characteristics such as image sharpness, graininess, and the like.

2. Description of the Prior Art

Generally speaking, in silver halide color photographic light-sensitive materials (hereinafter referred to as light-sensitive materials), their photographic characteristics are desired to be such that the density pattern composed of groups of image-forming elements is smooth and not coarse; that is, the graininess is satisfactory, and the configuration of the formed image pattern is so sharp that its fine detail is clearly depicted; that is, the image sharpness is excellent. In recent years, the above desire has been increasing with the increase in the speed of color light-sensitive materials and the reduction in the size of cameras. As for the graininess, it is known that its improvement can be attained by providing an interlayer in between high-speed and low-speed emulsicn layers. Japanese Patent Examined Publication No. 15495/1974 describes the use of a gelatin layer or a low color density-formable medium-speed silver halide emulsion layer as the interlayer; Japanese Patent Publication Open to Public Inspection (hereinafter referred to as Japanese patent O.P.I. publication) No. 7230/1978 describes the use of a medium-speed silver halide layer as the interlayer containing a DIR compound releasing a development inhibitor by its reaction with the oxidized product of a color developing agent; and Japanese patent O.P.I. Publication No. 155539/1982 describes the provision of a non-light-sensitive interlayer containing a coupler which forms the same color as that of one contained in a high-speed emulsion layer and whose coupling rate is lower than that of the one in the high-speed emulsion layer. These disclosed techniques to provide an interlayer, however, are disadvantageous in respect that they make a halfway improvement of the graininess and, besides, the provision of the interlayer itself increases the thickness of the light-sensitive material, thus deteriorating the image sharpness. As for the image sharpness, it is known that its improvement can be made by utilizing the adjoining effect of a certain diffusing material during development, the effect occuring due to the change in the diffusible inhibitor released during development. For the improvement by utilizing the adjoining effect, to be concrete, those methods are known which include a method of diluting the developer liquid with water; a method of vigorously stirring the developer liquid during development; a method of incorporating into the light-sensitive material a compound which releases a diffusible development inhibitor by its reaction with the oxidized product of a developing agent; and the like. The compound which releases a diffusible development inhibitor by its reaction with the oxidized product of a developing agent includes, e.g., those compounds producing a dye ard releasing a development inhibitor by its coupling reaction with the oxidized product of a color developing agent (hereinafter called "DIR coupler") as described in U.S. Pat. Nos. 3,148,062 and 3,227,544; those compounds which release a development inhibitor but forms no dye by its coupling reaction with the oxidized product of a color developing agent (hereinafter called "DIR material") as described in U.S. Pat. No. 3,632,345; and those DIR materials as described in Japanese patent O.P.I. Publication No. 145135, which indirectly release a development inhibitor by the secondary reaction induced by its reaction with the oxidized product of a color developing agent (hereinafter called "T-DIR material").

The adjoining effect by such diffusible development inhibitors released during development is disclosed also is many other patent publications and technical materials aside from the above disclosures. However, although it is known that the adjoining effect of any of these DIR compounds improves the image sharpness, the improvement is still not on any satisfactory level; nor is that of the graininess, either.

OBJECTS OF THE INVENTION

It is therefore a first object of the present invention to provide a high-speed color light-sensitive material which is improved on such the disadvantages which have not been overcome by conventional techniques and which is particularly excellent in the graininess.

It is a second object of the present invention to provide a high-speed color light-sensitive material which is conspicuously improved on the image sharpness.

Other objects of the present invention will become apparent from what are described hereinafter.

DETAILED DESCRIPTION OF THE INVENTION

The above objects of the present invention are accomplished by the following silver halide photographic light-sensitive material: In a silver halide photographic light-sensitive material comprising a support having thereon at least one silver halide emulsion layer, the silver halide photographic light-sensitive material, wherein at least one of the foregoing silver halide emulsion layers substantially contain a group of monodisperse core/shell-type silver halide grains, the said silver halide grains containing in the core thereof not less than 8 mole % silver iodide, and contain a DIR compound which is a compound reacting with the oxidized product of a color developing agent to release a development inhibitor whose relative development inhibitability $\rho s$ defined below is not smaller than 1. Wherein, the definition of the above-mentioned relative development inhibitability $\rho s$ is as follows:

$$\rho s = \frac{\rho}{\rho B} \qquad \rho = 1 - \frac{\gamma i}{\gamma 0}$$

wherein, $\gamma i$ represents a gradient value of a silver halide photographic light-sensitive material containing the aforementioned DIR compound, rendered when color-developed;

$\gamma 0$ represents a gradient value of the silver halide photographic light-sensitive material not containing the DIR compound, rendered when color-developed;

$\rho$ represents a development inhibitability of the DIR compound; and $\rho B$ represents a development inhibitability of the following standard DIR compound $D_B$ and it is defined by $1-\gamma 1/\gamma 0$ as the development inhibitability $\rho$ is defined.

Standard DIR compound $D_B$

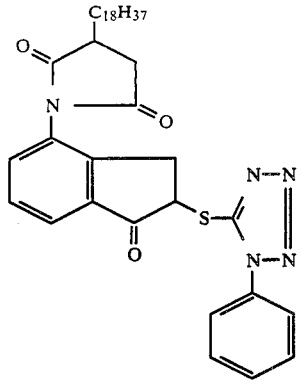

In addition, in the embodiment of the present invention, the foregoing substantially monodisperse core/-shell-type silver halide grains contain in the shell thereof preferably from 0.1 to 6 mole % silver halide, and the thickness of the shell is preferably from 0.01 to 0.1μ.

The present invention will be illustrated in detail.

The foregoing group of substantially monodisperse silver halide grains of the present invention is preferably one whose coefficient of variation (V.C.) of the grain distribution as defined by the following formula (A), i.e., the value obtained when Standard Deviation s is divided by Average Grain Size $\bar{r}$, is not greater than 0.15.

$$\frac{S}{r} \leqq 0.15$$

$$S = \sqrt{\frac{\Sigma (r - r_i)^2 n_i}{\Sigma n_i}}$$

The term "average grain size" used herein, when the silver halide grains each is globular, is the average grain's diameter, and, when the grains each is cubic or in any form other than the globular form, is the average value of the diameters calculated in terms of round images corresponding in the area to the projection images of the grains; and if each individual grain is $r_i$ and if the number of the grains is $n_i$, the $\bar{r}$ is defined by the following formula:

$$r = \frac{\Sigma n_i r_i}{\Sigma n_i}$$

In addition, the above-mentioned grain size can be determined by various methods used generally by those skilled in the art for the above purpose. Typical methods for the determination are described in, Loveland, "Methods for Analyzing Grain Sizes" on pp. 94–122 (1955) of the A.S.T.M. Symposium on Light Microscopy, and in Chapter 2 of, Mees and James, "The Theory of the Photographic Process," 3rd. ed., published by McMillan Co.

The grain size can be determined by using the projection area of or an approximate value close to the diameter of each grain. If the grains are in the substantially uniform shape, the grain size distribution can be considerably accurately expressed as the distribution of the diameters or projection areas of the grains.

A grain size with granularity distribution may be determined by the method described in, Trivelli and Smith, "Experiential Relations between the Sensitometric Distribution and the Granularity Distribution in Photographic Emulsions" in the Photographic Journal, vol. LXXIX, 330–338 (1949).

The substantially monodisperse silver halide grains of the present invention may be used alone or in an arbitrary mixture of two or more monodisperse silver halide grains different in the average grain size.

Each of the monodisperse silver halide grains of this invention is of the construction comprised of two or more layers different in the silver halide content; that is, of the core/shell type. The silver iodide content of the core is not less than 8 mole %. The grains are substantially monodisperse silver halide grains. The size of each grain is from 0.1 to 5μ, and preferably from 0.2 to 2μ. The silver iodide content of the shell is preferably from 0.1 to 6 mole %. The transition in the interface from this silver iodide content of the shell to that of the core, not less than 8 mole % silver iodide, may be of either a sharp boundary or a continuous, not necessarily clear boundary.

The silver iodide content of the core is preferably from 8 to 30 mole %. The shape of each monodisperse silver halide grain of the present invention is allowed to be any of a hexahedron, octahedron, tetradecahedron, plate form, or sphere. The grains may be a mixture of these various forms, but a mixture of hexahedral, octahedral and tetradecahedral grains is useful. The preparation of desired size-having monodisperse silver halide grains may be carried out by the double-jet method with the pAg kept constant. Highly monodisperse silver halide grains may be prepared by the method described in Japanese Patent O.P.I. Publication No. 48521/1979; for example, an aqueous potassium bromide-gelatin solution and an aqueous ammoniacal silver nitrate solution are added at a rate varied as the function of time to an aqueous gelatin solution, wherein the function of time, pH, pAg, temperature, etc., are arbitrarily selected, whereby highly monodisperse silver halide grains can be obtained.

Onto the core of the thus obtained monodisperse silver halide grains, for example, a water-soluble halogen compound and a water-soluble silver salt solution are used to deposit a shell by the double-jet method, whereby a monodisperse core/shell-type silver halide grains can be formed. The monodisperse core/shell-type silver halide emulsion of the present invention, if the thickness of the core is smaller than 0.01μ, outside the preferred range of from 0.01 to 0.1μ, makes no great difference in the photographic characteristics from the non-shell monodisperse silver halide emulsion, whereas if the thickness is greater than 0.1μ, cannot show fully the effect of the present invention.

Methods for the preparation of the above core/shell-type silver halide grains are described also in, e.g., West German Patent No. 1,169,290, British Patent No. 1,027,146, Japanese Patent O.P.I. Publication No. 154232/1982, Japanese Patent Examined Publication No. 1417/1976, and the like.

In the present invention, in the course of the preparation of the monodisperse silver halide grains of the invention, salts such as a cadmium salt, zinc salt, lead salt, thalium salt, iridium salt, or a complex salt of these salts, or a rhodium salt or a complex salt thereof, or the like, may be present.

samples is then subjected to an exposure and color development.

Magenta Coupler (M-1)

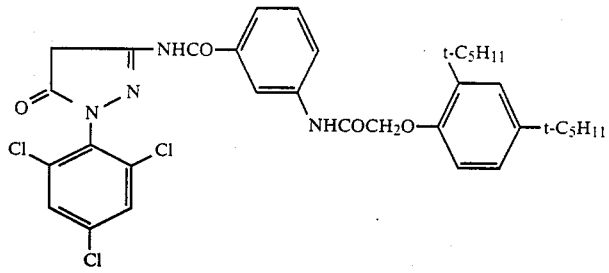

Colored Magenta Coupler (CM-1)

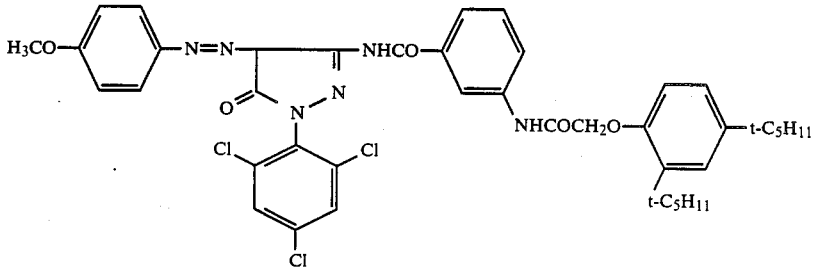

The monodisperse silver halide grains of the present invention are used along with a hydrophilic colloidal binder (such as gelatin) usually used by those in the art to compose a silver halide emulsion.

Subsequently, the selection of a DIR compound as the DIR compound of the present invention; i.e., one whose relative inhibitability $\rho s$ with respect to the development inhibitability $\rho B$ of the foregoing standard DIR compound $D_B$ is not smaller than 1, will be described below:

Since the value of the relative inhibitability $\rho s$ is affected by the gradient value $\gamma$ that is given by the color development of a silver halide light-sensitive material into which is incorporated the relative inhibitability as the defined factor, the value can be found in the practical conditions of the development. Because the relative inhibitability is the ratio between the development inhibitabilities $\rho B$ and $\rho$ of the standard DIR compound and the DIR compound of the present invention, respectively, the development inhibitability is found first.

An emulsion to be used is prepared in the manner that a silver iodobromide emulsion containing 4 mole % silver iodide of an average grain size of $0.4\mu$ (coefficient of variation in the grain size distribution, V.C.=0.15) prepared by the function addition method is sensitized by gold and sulfur sensitizers and spectrally sensitized by the addition of a green-sensitizing dye, and into this emulsion is dispersed in usual manner spending 20 minutes by means of a homogenizer a mixture of a solution of the following magenta coupler (M-1) and colored magenta coupler (CM-1) dissolved into tricresyl phosphate and a surface active agent alkylnaphthalene sulfonate (Alkanol B, a product of DuPont). In this emulsion, the quantity of the coupler (M-1) is controlled to be 0.078 mole per mole of silver.

The thus prepared master test emulsion and another test emulsion prepared by adding the DIR compound in a quantity of $2\times10^{-3}$ mole per mole of silver to the above emulsion each is coated on cellulose acetate film so that the coated quantity of the Ag is 16 mg/dm$^2$ and that of the gelatin is 39 mg/dm$^2$. Each of the coated That is, both test emulsions-coated samples each is exposed through an optical wedge to a white light, and then processed in the following baths to thereby obtain dye images.

| Processing Steps (at 38° C.) | Processing Time |
|---|---|
| Color developing | 3 min. & 15 sec. |
| Bleaching | 6 min. & 30 sec. |
| Washing | 3 min. & 15 sec. |
| Fixing | 6 min. & 30 sec. |
| Washing | 3 min. & 15 sec. |
| Stabilizing | 1 min. & 30 sec. |
| Drying | |

The compositions of the processing liquids used are as follows:

| | |
|---|---|
| Color Developer: | |
| 4-amino-3-methyl-N—ethyl-N—($\beta$-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate, monohydrated | 2.5 g |
| Potassium hydroxide | 1.0 g |
| Water to make 1 liter | |
| Bleacher: | |
| Iron-ammonium ethylenediaminetetraacetate | 100.0 g |
| Diammonium ethylenediamine tetraacetate | 10.0 g |
| Ammonium bromide | 150.0 g |
| Glacial acetic acid | 10.0 ml |
| Water to make 1 liter. Use aqueous ammonia to adjust the pH to 6.0. | |
| Fixer: | |
| Ammonium thiosulfate | 175.0 g |
| Anhydrous sodium sulfite | 8.6 g |
| Sodium metasulfite | 2.3 g |
| Water to make 1 liter. Use acetic acid to adjust the pH to 6.0. | |
| Stabilizer: | |
| Formalin (aqueous 37% solution) | 1.5 ml |
| Koniducks (a product of Konishiroku Photo Industry Co., Ltd.) | 7.5 ml |

-continued

| |
|---|
| Water to make 1 liter. |

The characteristic curves of the samples are obtained from the above-processed results. The curves each is used to find the tangent of the angle formed by the straight line connecting the fog+0.3 density point with the density point at Exposure log E (log E+1.0) to the exposure axis (the axis of abscissa). The tangent is regarded as gradient $\gamma$. If the $\gamma$ obtained from the master test emulsion is regarded as $\gamma 0$, and that from the test emulsion as $\gamma i$, then $\rho = 1-(\gamma i/\gamma 0)$ can be obtained.

In the above manner, the $\rho B$ of the standard DIR compound $D_B$ comes to 0.23. Thus the $\rho s$ is detected, whereby one to be the DIR compound of the invention is selected.

The DIR compound whose relative inhibitability $\rho s$ is larger than 1 includes the following compounds, but the compounds useful in the present invention are not limited thereto.

| | | DIR effect values |
|---|---|---|
| (D-2) | 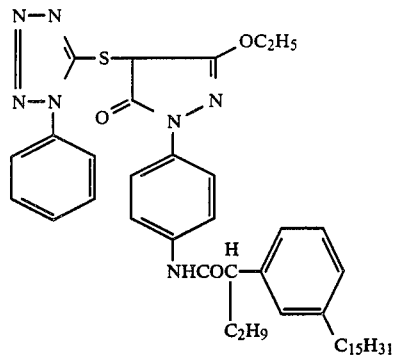 | $\rho$ = 0.30<br>$\rho s$ = 1.30 |
| (D-3) | 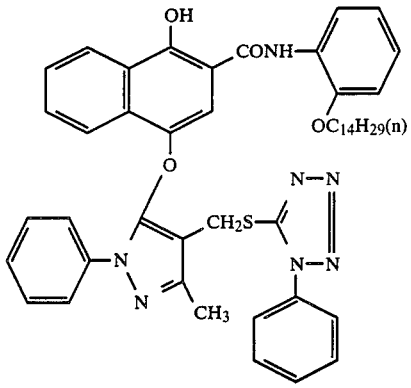 | $\rho$ = 0.38<br>$\rho s$ = 1.65 |
| (D-4) | 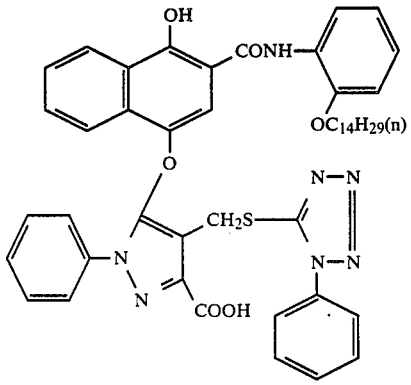 | $\rho$ = 0.40<br>$\rho s$ = 1.74 |

-continued
| | | DIR effect values |
|---|---|---|
| (D-5) | 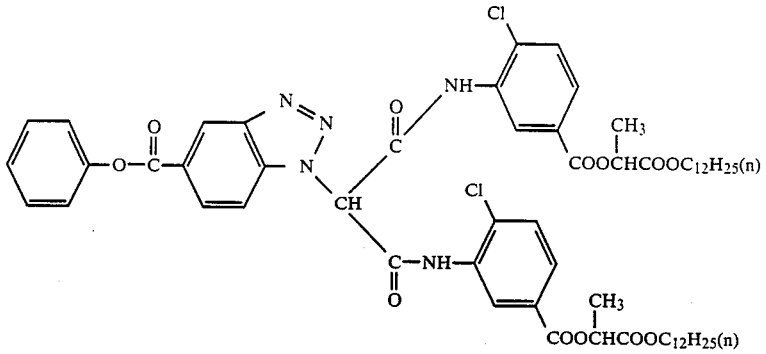 | $\rho$ = 0.30<br>$\rho s$ = 1.30 |
| (D-6) | 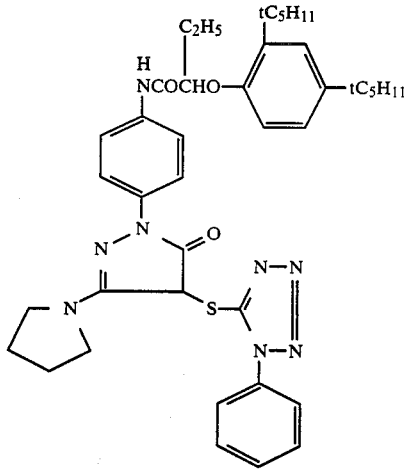 | $\rho$ = 0.30<br>$\rho s$ = 1.30 |
| (D-7) | 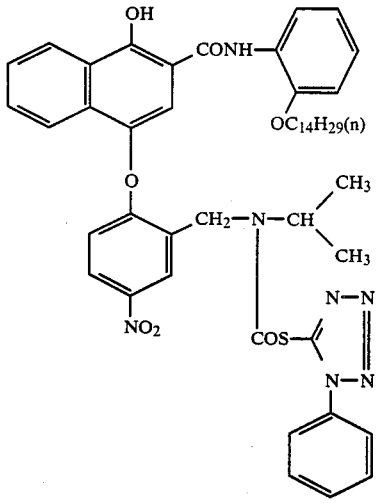 | $\rho$ = 0.32<br>$\rho s$ = 1.39 |
| (D-8) | 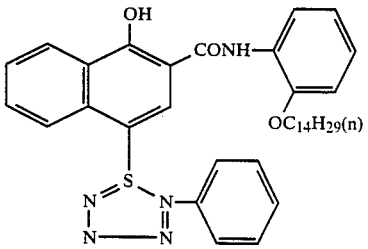 | $\rho$ = 0.31<br>$\rho s$ = 1.35 |

-continued
| | | DIR effect values |
|---|---|---|
| (D-9) | 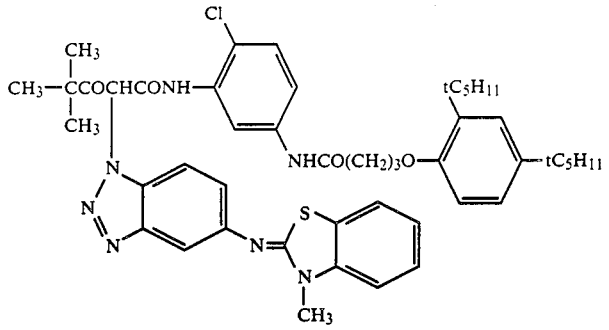 | $\rho = 0.28$<br>$\rho s = 1.22$ |
| (D-10) | 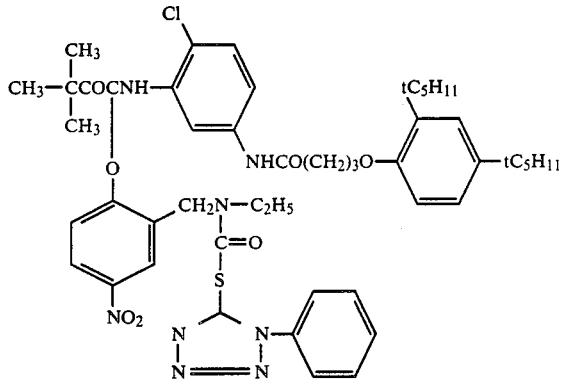 | $\rho = 0.33$<br>$\rho s = 1.43$ |
| (D-11) | 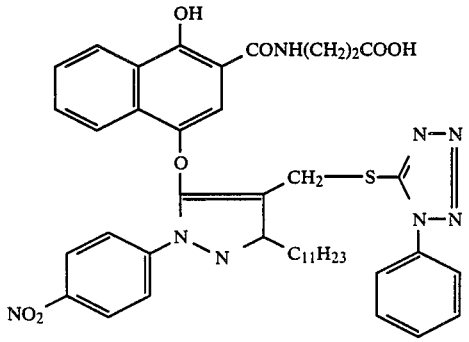 | $\rho = 0.32$<br>$\rho s = 1.39$ |
| (D-12) | 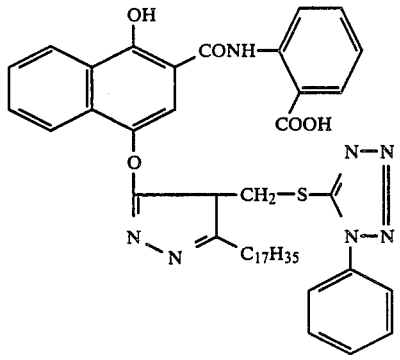 | $\rho = 0.30$<br>$\rho s = 1.30$ |
The DIR compound whose development inhibitability is weaker than that of the standard DIR compound $D_B$; that is, $\rho s \leqq 1$, includes the following compounds:

(D-13)
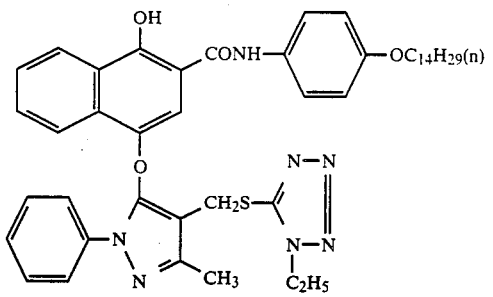
$\rho = 0.12$
$\rho s = 0.52$
(D-14)
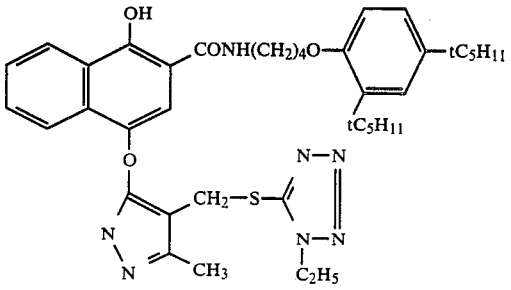
$\rho = 0.10$
$\rho s = 0.43$
(D-15)
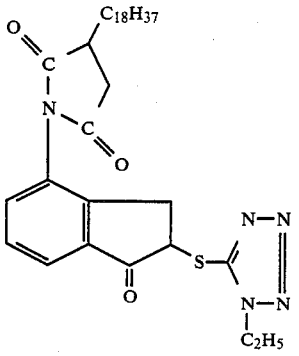
$\rho = 0.11$
$\rho s = 0.48$
(D-16)
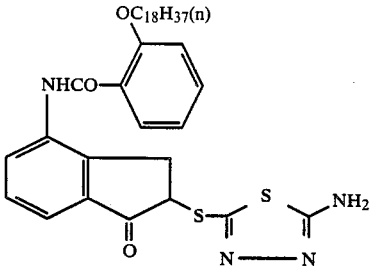
$\rho = 0.14$
$\rho s = 0.61$
(D-17)
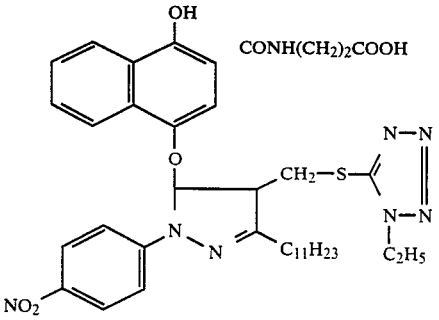
$\rho = 0.11$
$\rho s = 0.48$ -continued (D-18)

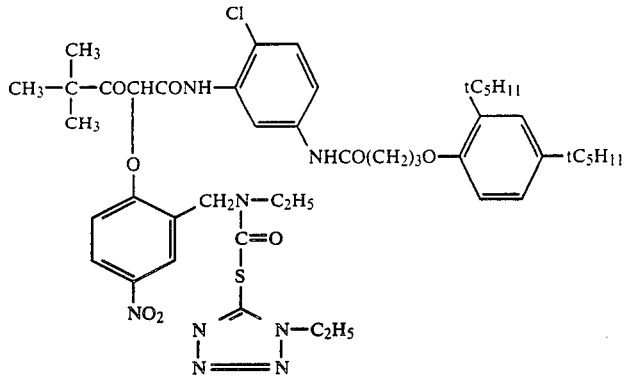

$\rho = 0.13$
$\rho s = 0.57$ (D-19)

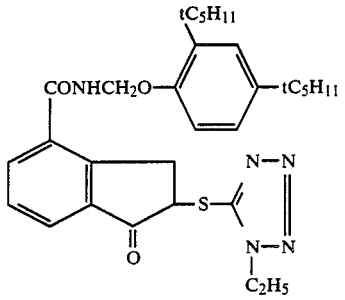

$\rho = 0.09$
$\rho s = 0.39$ (D-20)

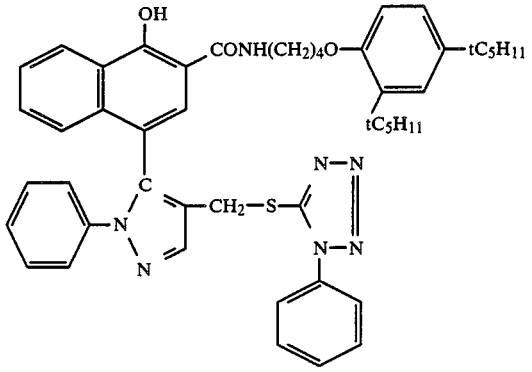

$\rho = 0.21$
$\rho s = 0.91$

In the color light-sensitive material of this invention, the DIR compound whose $\rho s$ is equal to or greater than 1 ($\rho s \geqq 1$) is desirable to be added in the quantity range of from 0.0001 to 0.01 mole per mole of silver halide.

When the silver halide emulsion layer of this invention is applied to an ordinary multi-layer color light-sensitive material comprising blue-sensitive, green-sensitive and red-sensitive emulsion layers, one or two or more of these layers may satisfy the above conditions. And if a certain color sensitivity-having emulsion layer consists of a plurality of layers (e.g., two or three layers) different in the speed, the silver halide emulsion layer of this invention may be applied to one or two or more of these layers.

The monodisperse silver halide emulsion layer of this invention, when applied to one or two or more layers of a color light-sensitive material, may, as previously mentioned, be used alone in a certain layer or used in a mixture with another silver halide emulsion different from the above-mentioned emulsion. For example, the monodisperse silver halide grains-containing emulsion of this invention may be used in a mixture with an emulsion containing polydisperse silver halide grains.

The monodisperse silver halide grains of this invention are desirable to be used in a quantity of not more than 80% of the whole silver halide amount in all the layers of a color light-sensitive material.

The previously mentioned construction of the present invention; that is, the combination of a monodisperse core/shell-type silver halide emulsion whose silver iodide content of its core is not less than 8 mole % with a DIR compound whose relative inhibitability $\rho s$ is not less than 1, accomplishes a remarkable improvement of a color light-sensitive material on the image sharpness and graininess thereof due to the synergistic effect of the combination. This remarkable improvement of the image sharpness and graininess prevents the deterioration of the graininess caused by the diffusion of the oxidized product of a color developing agent. This is considered due to the development inhibiting effect in the initial stage of development by the DIR compound whose relative inhibitability $\rho s$ is not less than 1, and also due to the additional development inhibiting effect in the subsequent stage by the iodine ion released during development of the high silver iodide. And these effects are considered to promote also the adjoining effect, thus leading to a further remarkably improved image sharpness. The effect of the present invention can also be obtained in a single-layer light-sensitive material, but is particularly conspicuous in a multi-layer light-sensitive material.

The silver halide emulsion of the present invention may be spectrally sensitized by use of various dyes which are those polymethine dyes including cyanines, merocyanines, complex cyanines and complex merocyanines (i.e., tri-, tetra- and polynuclear cyanines and merocyanines), oxonols, hemioxonols, styryls, and streptocyanines.

These cyanine spectrally-sensitizing dyes include those comprising two basic heterocyclic nuclei combined by the methine linkage as derived from those quaternary salts of quinolinium, pyridinium, isoquinolinium, 3H-indolium, oxazolium, oxazolinium, thiazolium, thiazolinium, selenazolium, selenazolinium, imidazolium, imidazolinium, benzoxazolinium, benzothiazolium, benzoselenazolium, benzimidazolium, naphthoxazolium, naphthothiazolium, naphthoselenazolium, thiazolinium, dihydronaphthothiazolium, pyrylium and imidazopyradinium.

These merocyanine spectrally-sensitizing dyes include those comprising the acid nucleus combined with the cyanine-dye-type basic heterocyclic nucleus by the methine linkage as derived from barbituric acid, 2-thiobarbituric acid, rhodanine, hydantoin, 2-thiohydantoin, 4-thiohydantoin, 2-pyrazoline-5-one, 2-isooxazoline-5-one, indan-1,3-dione, cyclohexane-1,3-dione, 1,3-dioxane-4,6-dione, pyrazoline-3,5-dione, pentane-2,4-dione, alkylsulfonylacetonitrile, malononitrile, isoquinoline-4-one and chroman-2,4-dione.

These spectrally sensitizing dyes useful for sensitizing the silver halide emulsion layer are described in British Patent No. 742,112, U.S. Pat. Nos. 1,846,300, 1,846,301, 1,846,302, 1,846,303, 1,846,304, 2,078,233, 2,089,729, 2,165,338, 2,213,238, 2,231,658, 2,493,747, 2,493,748, 2,526,632, 2,739,964 U.S. Pat. No. Re.24,292), 2,778,823, 2,917,516, 3,352,857, 3,411,916, 3,431,111, 2,295,276, 2,481,698, 2,503,776, 2,688,545, 2,704,714, 2,921,067, 2,945,763, 3,282,933, 3,397,060, 3,660,102, 3,660,103, 3,335,010, 3,352,680, 3,384,486, 3,397,981, 3,482,978, 3,623,881, 3,718,470 and 4,025,349. Examples of useful combinations of dyes including supersensitizing dyes are described in, e.g., U.S. Pat. Nos. 3,506,443 and 3,672,898. Examples of supersensitizing combinations by use of spectrally sensitizing dyes with non-light-absorbing additives include the use of a thiocyanate in the course of the spectrally sensitizing process as disclosed in U.S. Pat. No. 2,221,805; the use of bistriazyniylaminostilbene as disclosed in U.S. Pat. No. 2,933,390; the use of a sulfonated aromatic compound as disclosed in U.S. Pat. No. 2,937,089; the use of a mercapto-substituted heterocyclic compound as disclosed in U.S. Pat. No. 3,457,078; the use of an iodide as disclosed in British Patent No. 1,413,826; and the use of those compounds as described in, Gilman, "Review of the Mechanism of Supersensitization," and equivalent other compounds.

The adding point of time of these sensitizing dyes described above may be the initial stage of the chemical ripening (also called the second ripening) of a silver halide emulsion, during the progress of the ripening, after completion of the ripening, or at an appropriate point of time prior to the coating of an emulsion.

The incorporation of these sensitizing dyes may be made by conventionally proposed various methods. For example, as described in U.S. Pat. No. 3,469,987, the incorporation may be made in the manner that a sensitizing dye is dissolved into a volatile organic solvent, and this solution is then dispersed into a hydrophilic colloid, and the dispersed liquid is subsequently added to an emulsion. Further, these sensitizing dyes of the present invention may be dissolved together into a same single solvent or separately into different solvents, and this solution is added to or these solutions may be added separately to or in a mixture thereof to an emulsion.

In the present invention, as the solvent for use in dissolving these dyes to be added to a silver halide photographic emulsion, water-miscible solvents such as methyl alcohol, ethyl alcohol, acetone, etc., may be suitably used.

The adding quantity of these sensitizing dyes to a silver halide emulsion is from $1\times10^{-5}$ mole to $2.5\times10^{-2}$ mole, and preferably from $1.0\times10^{-4}$ mole to $1.0\times10^{-3}$ mole per mole of silver halide.

The silver halide grains of the present invention may be subjected to various chemical sensitiztion treatments which are generally applied. The chemical sensitization may be effected by using alone or in combination active gelatin; noblemetallic sensitizers such as water-soluble gold salts, watersoluble platinum salts, water-soluble palladium salts, watersoluble rhodium salts, water-soluble iridium salts, etc.; sulfur sensitizers; selenium sensitizers; reduction sensitizers such as polyamines, stannous chloride, etc.; and the like.

In the present invention, as the above sulfur sensitizers, those known may be used which include, e.g., thiosulfates, allylthiocarbamidothiourea, arylisothiacyanate, cystine, p-toluenethiosulfonate, rhodanine, and the like. In addition, those sulfur sensitizers may also be used which are disclosed in U.S. Pat. Nos. 1,574,944, 2,410,689, 2,278,947, 2,728,668, 3,501,313, 3,656,955, West German patent No. 1,422,869, Japanese Patent Examined Publication No. 24937/1981, and Japanese Patent O.P.I. Publication No. 45016/1980. These sulfur sensitizers may be added in a quantity enough to effectively increase the speed of the emulsion of this invention. The quantity to be added depends largely on various conditions such as pH, temperature, the sizes of silver halide grains, but may, as a standard, be preferably from about $10^{-7}$ mole to about $10^{-1}$ mole per mole of silver halide.

In the present invention, selenium sensitizers may be used in place of the above sulfur sensitizers, the selenium sensitizers including aliphatic isoselenocyanates such as allylisoselenocyanate; selenoureas; selenoketones; selenoamides; selenocarboxylic acids and esters thereof; selenophosphates; selenides such as diethyl selenide, diethyl diselenide, etc.; and the like. Examples of these are described in U.S. Pat. Nos.1,574,944, 1,602,592 and 1,623,499.

The adding quantity of these selenium sensitizers varies in a wide range just as that of the sulfur sensitizers does, but may, as a standard, be preferably from about $10^{-7}$ mole to about $10^{-3}$ mole per mole of silver halide.

Gold sensitizers useful in the present invention may be of an oxidation number of either +1 or +3, and include a large variety of gold sensitizers which are typified by chloroaurates, potassium chloroaurate, auric trichloride, potassium auricthiocyanate, potassium iodoaurate, tetracyanoauric acid, ammonium aurothiocyanate, pyridyltrichloro-gold, and the like.

The adding quantity of these gold sensitizers differs according to various conditions, but may, as a standard, be preferably from about $10^{-7}$ mole to about $10^{-1}$ mole per mole of silver halide.

The sensitization of the silver halide grains of this invention may be effected by combined use of any of the above sensitizers with any of other noble metals such as platinum, palladium, iridium, rhodium, etc., or salts of these metals.

In the present invention, further, reduction sensitization may be combinedly used. No particular restrictions are put on reducing agents, but ones useful in this invention are those knowncompounds including stannous chloride, thiourea dioxide, hydrazine derivatives and silane compounds.

The reduction sensitization is desirable to be performed during the growth of silver halide grains or after completion of the sulfur and gold sensitization.

The silver halide emulsion used in this invention may, at an optional point of time, be present along with any of known silver halide solvents. The silver halide solvents include (a) those organic thioethers as described in U.S. Pat. Nos. 3,271,157, 3,531,289 and 3,574,628, Japanese Patent O.P.I. Publication Nos. 1019/1979 and 158917/1979, and Japanese Patent Examined Publication No. 30571/1983, (b) those thiourea derivatives as described in Japanese Patent O.P.I. Publication Nos. 82408/1978, 77737/1980 and 29829/1980, (c) those AgX solvents having a thiocarbonyl group interposed between sulfur and nitrogen atoms as described in Japanese Patent O.P.I. Publication No. 144319/1978, (d) those imidazoles as described in Japanese Patent O.P.I. Publication No. 100717/1979, (e) sulfites, (f) thiocyanates, (g) ammonia, (h) those hydroxyalkyl-substituted ethylenediamines as described in Japanese Patent O.P.I. Publication No. 196228/1982, (i) those substituted mercaptotetrazoles as described in Japanese Patent O.P.I. Publication No. 202531/1982, (j) those substituted benzimidazoles as described in Japanese Patent O.P.I. Publication No. 54333/1983, and the like.

Into the silver halide emulsion of this invention may be incorporated upon completion of the chemical ripening thereof various compounds for the purpose of preventing the possible occurrence of fog during the manufacturing process, storage, or processing thereof or of stabilizing the photographic characteristics thereof. For example, those known compounds may be added as antifoggants or stabilizers, which include azoles such as benzothiazolium salts, nitroindazoles, nitrobenzimidazoles, chlorobenzimidazoles, bromobenzimidazoles, mercaptothiazoles, mercaptobenzimidazoles, aminotriazoles, benzotriazoles, nitrobenzotriazoles, mercaptotetrazoles (particularly 1-phenyl-5-mercaptotetrazole), and the like; and mercaptopyrimidines, mercaptotriazines, thioketo compounds such as oxazolinethione; and further, benzenethiosulfinic acid, benzenesulfinic acid, benzenesulfonic acid amide, hydroquinone derivatives, aminophenol derivatives, gallic acid derivatives, ascorbic acid derivatives, and the like.

Any of these chemicals is desirable to be added to the emulsion during the chemical ripening thereof or prior to the coating of the emulsion.

Materials usable as the binder of the silver halide emulsion of this invention include gelatin and various hydrophilic colloidal materials. The gelatin includes not only gelatin but gelatin derivatives. The gelatin derivatives include the reaction products of gelatin with acid anhydrides, the reaction products of gelatin with isocyanates, and the reaction products of gelatin with those compounds having an active halogen atom. Those acid anhydrides for use in the reaction with gelatin include, for example, maleic anhydride, phthalic anhydride, benzoic anhydride, acetic anhydride, isatoic anhydride, succinic anhydride, and the like. Those cyanates usable in the reaction with gelatin include, e.g., phenyl isocyanate, p-bromophenyl isocyanate, p-chlorophenyl isocyanate, p-tolyl isocyanate, p-nitrophenyl isocyanate, naphthyl isocyanate, and the like.

Further, those compounds having an active halogen atom, usable in the reaction with gelatin include, e.g., benzenesulfonyl chloride, p-methoxybenzenesulfonyl chloride, p-phenoxybenzenesulfonyl chloride, p-bromobenzenesulfonyl chloride, p-toluenesulfonyl chloride, m-nitrobenzenesulfonyl chloride, m-sulfobenzoyl dichloride, naphthalene-$\beta$-sulfonyl chloride, p-chlorobenzenesulfonyl chloride, 3-nitro-4-aminobenzenesulfonyl chloride, 2-carboxy-4-bromobenzenesulfonyl chloride, m-carboxybenzenesulfonyl chloride, 2-amino-5-methylbenzenesulfonyl chloride, phthalyl chloride, p-nitrobenzoyl chloride, benzoyl chloride, ethyl chlorocarbonate, furoyl chloride, and the like.

For the preparation of the silver halide emulsion of this invention, aside from the above-mentioned gelatin derivatives and ordinary photographic gelatin, those hydrophilic colloidal materials also may, if necessary, be used which include colloidal albumin, agar-agar, gum arabic, dextran, alginic acid; cellulose derivatives such as cellulose acetate hydrolyzed so that the acetyl content thereof is from 19 to 26%; polyacrylamides, imidated polyacrylamides, casein; urethanecarboxylic acid group- and cyanoacetyl group-containing vinylalcohol polymers such as vinyl alcohol-vinylcyanoacetate copolymer; polyvinyl alcohol-polyvinylpyrolidone, hydrolyzed polyvinyl acetate; polymers obtained by the polymerization of proteins or saturated acylated proteins and vinyl group-having monomers; polyvinyl pyridine, polyvinylamines, polyaminoethyl methacrylate, polyethyleneimines, and the like.

The silver halide emulsion of this invention may contain any of various surface active agents for various purposes such as for coating aid, the prevention of static electricity, the improvement of smoothness, emulsification-dispersion, the prevention of adherence, the improvement of photographic characteristics (such as development acceleration, hardening, sensitization, etc.), and the like. That is, there may be used those surface active agents as described in U.S. Pat. Nos. 2,240,472, 2,831,766, 3,158,484, 3,210,191, 3,294,540 and 3,507,660; British Patent Nos. 1,012,495, 1,022,878, 1,179,290 and 1,198,450; U.S. Pat. Nos. 2,739,891, 2,823,123, 1,179,290, 1,198,450, 2,739,891, 2,823,123, 3,068,101, 3,415,649, 3,666,478 and 3,756,828; British Patent Nos. 1,397,218, 3,113,816, 3,411,413, 3,473,174, 3,345,974, 3,726,683 and 3,843,368; Belgium Patent No. 731,126; British Patent Nos. 1,138,514, 1,159,825 and 1,374,780; U.S. Pat. Nos. 2,271,623, 2,288,226, 2,944,900, 3,235,919, 3,671,247, 3,772,021, 3,589,906, 3,666,478 and 3,754,924; West German OLS Patent No. 1,961,683; Japanese Patent O.P.I. Publication Nos. 117414/1975 and 59025/1975; and Japanese Patent Examined Publication Nos. 378/1965, 379/1965 and 13822/1968, which include, for example, nonionic surface active agents such as saponin (steroid type), alkylene oxide derivatives (such as polyethylene glycol, polyethylene glycol/polypropylene glycol condensate, polyethylene glycol alkyl or alkylaryl ether polyethylene glycol esters, polyethylene glycol sorbitane esters, polyalkylene glycol alkylamines or amides, polyethylene oxide addition products of silicone), glycidol derivatives (such as alkenyl succinic acid polyglyceride, alkylphenol polyglyceride), aliphatic acid esters of polyhydric alcohols, alkyl esters, urethanes and ethers of sugar, and the like; anionic surface active agents containing such acid groups as carboxy, sulfo, phospho, sulfuric acid ester or phosphoric acid ester group, such as triterpenoid-type saponin, alkyl carboxylates, alkyl benzenesulfonates, alkyl naphthalenesulfonates, alkyl sulfates, alkyl phosphates, N-acyl-N-alkyl taurates, sulfosulfates, sulfoalkylpolyoxyethylenealkylphenyl esters, polyoxyethylenealkyl phosphates, and the like; amphoteric surface active agents such as amino acids, aminoalkylsulfonic acids, aminoalkyl sulfates or phosphates, alkylbetaines, aminimides, amine oxides, and the like; and cationic surface active agents such as alkylamine salts, aliphatic or aromatic quaternary ammonium salts, heterocyclic quaternary ammonium salts such as pyridium, imidazolium, etc., aliphatic or heterocyclic ring-containing sulfonium or sulfonium salts, and the like.

The silver halide emulsion of this invention, aside from the above surface active agent, may contain any of those imidazoles, thioethers, selenoethers, etc., as the development accelerator, as described in West German OLS Patent Nos. 2,002,871, 2,445,611 and 2,360,878; and British Patent No. 1,352,196.

When applying the silver halide emulsion of this invention to a color light-sensitive material, into the green-sensitive, red-sensitive and blue-sensitive silver halide emulsions of this invention may be incorporated magenta, cyan and yellow couplers in usual manner and by use of appropriate materials applied to ordinary color light-sensitive materials. The couplers used are desirable to be those nondiffusible having a hydrophobic group called the "ballasting group." The couplers may be either 4-equivalent or 2-equivalent to silver ions. They may be allowed to contain color-compensating effect-having colored couplers.

Further, the couplers may include those whose coupling reaction products are colorless.

Those useful as the yellow color-forming coupler are known open-chain ketomethylene-type couplers. Of these couplers, benzoylacetanilide-type and pivaloylacetanilide-type compounds are advantageous. Examples of the useful yellow color-forming couplers are those as described in U.S. Pat. Nos. 2,875,057, 3,265,506, 3,408,194, 3,551,155, 3,582,322, 3,725,072 and 3,891,445; West German Patent No. 1,547,868; West German OLS Patent Nos. 2,213,461, 2,219,917, 2,261,361, 2,414,006 and 2,263,875.

Those useful as the magenta color-forming coupler are pyrazolone-type compounds, indazlone-type compounds, cyanoacetyl compounds and the like. Particularly, the pyrazolone-type compounds are advantageous. Examples of the magenta color-forming couplers usable in this invention are those as described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445; West German Patent No. 1,810,464; West German OLS Patent Nos. 2,408,665, 2,417,945, 2,418,959 and 2,424,467; and Japanese Patent Examined Publication No. 6031/1965.

Those useful as the cyan color-forming coupler are phenol-type compounds, naphthol-type compounds, and the like. Examples of these compounds are those as described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383 and 3,767,411; West German OLS Patent Nos. 2,414,830 and 2,454,329; and Japanese Patent O.P.I. Publication No. 59838/1973.

As the colored coupler, those as described in U.S. Pat. Nos. 3,476,560, 2,521,908, 3,034,892; Japanese Patent Examined Publication Nos. 2016/1969, 22335/1963, 11304/1967 and 32461/1969; and West German OLS Patent No. 2,418,959 may be used.

The light-sensitive material of this invention may also contain a compound capable of releasing a development inhibiting agent during development in addition to the DIR compound. For example, those as described in U.S. Pat. Nos. 3,297,445 and 3,379,529; and West German OLS Patent No. 2,417,914 may be used. In addition, those couplers as described in Japanese Patent O.P.I. Publication Nos. 85549/1980, 94752/1982, 651,34/1981, 135841/1981, 130716/1979, 133734/1981 and 135841/1981; U.S. Pat. No. 4,310,618; British Patent No. 2,083,640; and Research Disclosure No. 18360 (1979), No. 14850 (1980), No. 19033 (1980), No. 19146 (1980), No. 20525 (1981) and No. 21728 (1982) may also be used.

As for the above couplers, two or more couplers may be incorporated into a single layer, or the same coupler may be incorporated into two or more layers of the light-sensitive material of this invention.

The incorporation of the coupler into the silver halide emulsion layer may be carried out by known methods; for example, those methods as described in U.S. Pat. No. 2,322,027 may be used.

That is, the coupler is dissolved into a solvent such as, e.g., a phthalic acid alkyl ester (such as dibutyl phthalate, dioctyl phthalate, etc.), a phosphoric acid ester (such as diphenyl phosphate, triphenyl phosphate, tricresyl phosphate, dioctylbutyl phosphate), a citric acid ester (such as tributyl acetylcitrate), a benzoic acid ester (such as octyl benzoate), an alkylamide (such as diethylaurylamide), or the like; or an organic solvent having a boiling point of from about 30° C. to 150° C., such as an alkyl acetate such as butyl acetate, secondary butyl alcohol, methyl-isobutyl ketone, $\beta$-ethoxyethyl acetate, methyl-cellosolve acetate, or the like, and the solution is then dispersed into a hydrophilic colloid. The above high-boiling and low-boiling organic solvents may be used in a mixture.

The coupler, if it has an acid group such as a carboxylic acid group or sulfonic acid group, is introduced into a hydrophilic colloid.

The coupler is incorporated into the silver halide emulsion layer in the quantity range of generally from $1\times10^{-3}$ mole to $5\times10^{-1}$ mole, and preferably from $1\times10^{-2}$ mole to $5\times10$ mole per mole of silver.

The light-sensitive material prepared by the present invention may contain an anti-color stain agent. The agent includes hydroquinone derivatives, aminophenol derivatives, gallic acid derivatives, and the like. Examples of such derivatives are described in U.S. Pat. Nos. 2,360,290, 2,336,327, 2,403,721, 2,418,613, 2,675,314, 2,701,197, 2,704,713, 2,728,659, 2,732,300 and 2,735,765; Japanese Patent O.P.I. Publication Nos. 92988/1975, 92989/1975, 93928/1975 and 110337/1975; and Japanese Patent Examined Publication No. 23813/1975.

Materials useful as the antistatic agent include alkaline salts of the reaction products of p-aminobenzenesulfonic acid with diacetyl cellulose, styrene-perfluoroalkyl-lithium maleate coplymer, styrene-maleic anhydride coplymer, and the like. Matting agents usable include methyl polymethacrylate, polystyrene, and alkali-soluble polymers, and the like. And colloidal silicon oxide is also usable. Latexes useful for improving the physical properties of the layer include copolymers of acrylic acid esters, vinyl esters, etc., with other monomers having an ethylene group. Gelatin plasticizers include glycerol and glycol-type compounds. Viscosity-increasing agents include styrene-sodium maleate coplymer, alkyl-vinyl ether-maleic acid copolymers, and the like.

Materials usable as the support of the light-sensitive material produced by use of the silver halide emulsion prepared in the above manner include, e.g., baryta paper, poly-ethylene-coated paper, polypropylene-synthetic paper, a glass plate, cellulose acetate, cellulose nitrate, polyvinyl acetal, polypropylene, polyester film such as of polyethylene terephthalate, etc., polystyrene, and the like. One suitable for the purpose for which the light-sensitive material is used is selected from among these materials.

Any of these support materials may, if necessary, be subjected to subbing treatment.

The color light-sensitive material produced by using the silver halide emulsion of this invention may be color-developed by the usually used color developing method.

EXAMPLES

The present invention will be illustrated in detail by the following examples.

In the examples, the detection of the image sharpness improving effect was made by a comparison between the magnitudes of MTF (Modulation Transfer Function) found with respect to the spatial frequencies of 10 lines/mm and 30 lines/mm.

The graininess (RMS) was detected in the following examples by a comparison of the 1000-fold values of standard deviation of the density variations of color images having a color density of 1.0, produced when scanned by a microdensitometer having a circular scanning aperture head of 25μ in diameter.

EXAMPLE-1

Various iodobromide emulsions as given in Table 1 were prepared in the following manners: Emulsion A was prepared by the usual double-jet method; Emulsion B, a monodisperse emulsion, by the function-addition method as described in Japanese Patent O.P.I. Publication No. 48521/1979; and Emulsions C, D, E, F, G and H, core/shell-type monodisperse emulsions, by the function-addition method. Table 1 shows the average particle sizes, coefficients of variation, and silver iodide content molar percentages of the silver halide

TABLE 1

| | Average grain size (μ) | Coefficient of variation (%) | Silver iodide content (mole %) | Remarks |
|---|---|---|---|---|
| A | 0.81 | 27 | 6 | By ordinary double-jet method |
| B | 0.82 | 14 | 10 | By function-addition method |
| C | 0.79 | 15 | Core 8/ shell 0 | By function-addition method |
| D | 0.80 | 14 | Core 5/ shell 0 | Core/shell emulsion (core 0.75μ) |
| E | 0.81 | 13 | Core 11/ shell 0.5 | Core/shell emulsion (core 0.76μ) |
| F | 0.80 | 13 | Core 17/ shell 0.1 | Core/shell emulsion (core 0.70μ) |
| G | 0.80 | 14 | Core 9/ shell 4 | Core/shell emulsion (core 0.66μ) |
| H | 0.81 | 12 | Core 14/ shell 0.5 | Core/shell emulsion (core 0.50μ) |

TABLE 2

| Sample | Emulsion | DIR compound | Adding q'ty of DIR compound (per mole of Ag) |
|---|---|---|---|
| 1 | A | (D-17) | $2.3 \times 10^{-3}$ |
| 2 | B | " | $3.0 \times 10^{-3}$ |
| 3 | C | " | $2.4 \times 10^{-3}$ |
| 4 | D | " | $3.5 \times 10^{-3}$ |
| 5 | E | " | $3.0 \times 10^{-3}$ |
| 6 | F | " | $2.5 \times 10^{-3}$ |
| 7 | G | " | $2.1 \times 10^{-3}$ |
| 8 | H | " | $2.8 \times 10^{-3}$ |
| 9 | A | (D-11) | $1.1 \times 10^{-3}$ |
| 10 | B | " | $1.4 \times 10^{-3}$ |
| 11 | C | " | $1.2 \times 10^{-3}$ |
| 12 | D | " | $1.6 \times 10^{-3}$ |
| 13 | E | " | $1.3 \times 10^{-3}$ |
| 14 | F | " | $1.1 \times 10^{-3}$ |
| 15 | G | " | $1.0 \times 10^{-3}$ |
| 16 | H | " | $1.3 \times 10^{-3}$ |

All the emulsions shown in Table 1 were chemically sensitized by gold-sulfur sensitizers and further spectrally sensitized by use of a green-sensitizing dye. To each of these emulsions were added the magenta coupler (M-1) and colored magenta coupler (CM-1) previously mentioned with the description of the relative inhibitability and further a dispersion liquid prepared by protect-dispersing in usual manner a solution of a DIR compound in combination as given in Table 2 dissolved into tricresyl phosphate. In the preparation, each coupler was added in a quantity of 0.1 mole per mole of silver halide, and the respective DIR compounds were added in the quantities given in Table 2. The thus prepared emulsions each was coated on a triacetyl cellulose support so that the coated amount of silver is 10 mg/100 $cm^2$ and that of gelatin is 25 mg/100 $cm^2$, whereby Samples 1 to 16 were prepared.

These samples each was exposed through an optical wedge to a white light, and then processed in the previously given processing baths in accordance with the previously mentioned processing procedure shown in the description of the relative inhibitability to thereby obtain a dye image. Each of the obtained color images was measured with respect to the gradient value (gamma), image sharpness and graininess (RMS) thereof. The obtained results are as given in Table 3, wherein the speed of each sample is given in the form of a relative speed.

TABLE 3

| Sample No. | Relative speed | Gradient (gamma) | MTF value (%) 10 lines/mm | MTF value (%) 30 lines/mm | RMS |
|---|---|---|---|---|---|
| 1 | 103 | 0.65 | 95 | 49 | 42 |
| 2 | 104 | 0.72 | 102 | 53 | 33 |
| 3 | 98 | 0.68 | 100 | 51 | 35 |
| 4 | 101 | 0.66 | 105 | 59 | 34 |
| 5 | 101 | 0.68 | 103 | 57 | 36 |
| 6 | 100 | 0.71 | 102 | 54 | 37 |
| 7 | 99 | 0.68 | 101 | 53 | 32 |
| 8 | 100 | 0.64 | 100 | 52 | 38 |
| 9 | 102 | 0.71 | 98 | 51 | 40 |

TABLE 3-continued

| Sample No. | Relative speed | Gradient (gamma) | MTF value (%) 10 lines/mm | 30 lines/mm | RMS |
|---|---|---|---|---|---|
| 10 | 104 | 0.69 | 106 | 60 | 32 |
| 11 | 97 | 0.68 | 110 | 75 | 33 |
| 12 | 101 | 0.70 | 106 | 58 | 30 |
| 13 | 100 | 0.70 | 115 | 87 | 18 |
| 14 | 99 | 0.67 | 114 | 78 | 17 |
| 15 | 98 | 0.66 | 113 | 73 | 15 |
| 16 | 101 | 0.69 | 108 | 60 | 31 |

As is apparent from Table 3, the samples of this invention, although similar in the speed and gamma to the non-invention samples, are remarkably improved on the graininess as compared to the non-invention samples.

EXAMPLE-2

A polydisperse iodobromide Emulsion I which contains 4 mole % silver iodide and whose average grain size is 0.41μ was prepared by the ordinary double-jet method. The emulsion was chemically sensitized by gold-sulfur sensitizers and spectrally sensitized by use of a red-sensitizing dye. To the chemically and spectrally sensitized Emulsion I was added in usual manner a dispersion liquid prepared by protect-dispersing a solution of the following cyan coupler (C-1) and colored coupler (CC-1) dissolved into tricresyl phosphate, the addition being made so that the coated amount of the cyan couplers are 0.094 mole per mole of silver halide. The thus prepared coating composition (A) was coated on a triacetyl cellulose support so that the coated amount of silver is 14 mg/100 cm² and that of gelatin is 27 mg/100 cm², upon which was superposedly coated simultaneously each of the coating compositions (B) containing silver halide emulsion, C-1, CC-1, DIR compound given in Table 4 so that the coated amount of silver is 19 mg/100 cm² and that or gelatin 25 mg/100 cm², whereby Samples 17 to 28 were prepared, and Sample 29 was prepared with a gelatin interlayer into which was dispersed the following cyan coupler (C-2) in between the above two compositions (A) and (B).

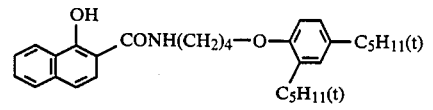

(C-1)

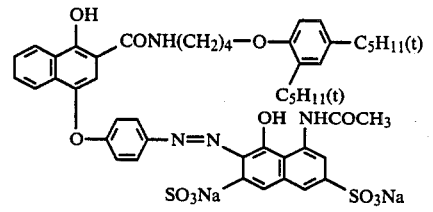

(CC-1)

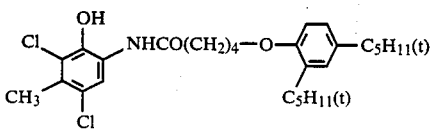

(C-2)

TABLE 4

| Sample No. | Em. | Adding q'ty of cyan couplers (C-1 + CC-1) (per mole of AgI) | DIR compound | Adding q'ty of DIR compound (per mole of Ag) | Remarks |
|---|---|---|---|---|---|
| 17 | D | 0.035 mole | (D-13) | $3.2 \times 10^{-3}$ | |

TABLE 4-continued

| Sample No. | Em. | Adding q'ty of cyan couplers (C-1 + CC-1) (per mole of AgI) | DIR compound | Adding q'ty of DIR compound (per mole of Ag) | Remarks |
|---|---|---|---|---|---|
| 18 | E | " | " | $2.7 \times 10^{-3}$ | |
| 19 | G | " | " | $2.3 \times 10^{-3}$ | |
| 20 | D | " | (D-3) | $1.3 \times 10^{-3}$ | |
| 21 | E | " | " | $1.0 \times 10^{-3}$ | |
| 22 | G | " | " | $9.5 \times 10^{-3}$ | |
| 23 | D | " | (D-7) | $1.5 \times 10^{-3}$ | |
| 24 | E | " | " | $1.1 \times 10^{-3}$ | |
| 25 | G | " | " | $1.0 \times 10^{-3}$ | |
| 26 | D | " | (D-8) | $1.4 \times 10^{-3}$ | |
| 27 | E | " | " | $1.1 \times 10^{-3}$ | |
| 28 | G | " | " | $1.0 \times 10^{-3}$ | |
| 29 | D | " | (D-20) | $2.6 \times 10^{-3}$ | Interlayer provided |

Note:
Emulsions D, E and G were chemically sensitized by gold-sulfur sensitizers and further spectrally sensitized by use of green-sensitizing dye.

Each of the above coated samples was subjected to the same exposure and processings as those performed in Example 1, whereby the results as given in Table 5 were obtained.

TABLE 5

| Sample No. | Relative speed | Gradient (gamma) | MTF value (%) 10 lines/mm | 30 lines/mm | RMS |
|---|---|---|---|---|---|
| 17 | 104 | 0.62 | 105 | 30 | 29 |
| 18 | 102 | 0.63 | 102 | 28 | 30 |
| 19 | 101 | 0.64 | 100 | 27 | 29 |
| 20 | 102 | 0.66 | 108 | 33 | 31 |
| 21 | 100 | 0.62 | 127 | 50 | 18 |
| 22 | 98 | 0.63 | 122 | 46 | 16 |
| 23 | 101 | 0.61 | 104 | 31 | 32 |
| 24 | 101 | 0.59 | 124 | 49 | 19 |
| 25 | 99 | 0.57 | 123 | 47 | 18 |
| 26 | 100 | 0.60 | 105 | 30 | 31 |
| 27 | 102 | 0.61 | 125 | 50 | 19 |
| 28 | 100 | 0.60 | 124 | 48 | 17 |
| 29 | 103 | 0.62 | 105 | 29 | 24 |

As is understood from Table 5, the samples of this invention (21, 22, 24, 25, 27, 28), although similar to the speed and gamma to the non-invention sample, are improved on the image sharpness as compared to the non-invention sample. Sample 29, provided with an interlayer, although seen contributing to the graininess to some extent, is deteriorated in the image sharpness. In contrast, the samples of this invention require no interlayer because they bring about no deterioration of the graininess caused by the formation of dense dye coherence in the adjoining interface between the highly dense coupler-containing low-speed layer and the less dense coupler-containing high-speed layer, thus enabling to reduce the thickness of the resulting light-sensitive material, largely contributing to the improvement of the image sharpness.

EXAMPLE-3

On a cellulose triacetate film base were coated Lyares 1 to 11 in order, whereby four different negative-type light-sensitive material Samples 30 to 33 were prepared. The emulsion layer used in Samples 30 and 31 comprises a low-speed emulsion layer and high-speed emulsion layer, the low-speed emulsion layer being a mixture of the Emulsion I of Example-2 with a newly prepared monodisperse core/shell-type iodobromide Emulsion J whose silver iodide content of the core is 6 mole % and whose shell is a pure silver bomide, the high-speed emulsion layer being of the Emulsion D given in Table 1. The emulsion used in Samples 32 and 33 comprises a low-speed emulsion layer and high-speed emulsion layer, the low-speed emulsion layer being a mixture of Emulsion I of Example-2 with a newly prepared core/-shell-type silver iodobromide Emulsion K whose silver iodide content of the core is 10 mole %, the high-speed emulsion layer being of Emulsion E in Table 1.

In samples 30, 31, 32 and 33, these emulsion layers and other photographic component layers were superposedly coated in the following order. In addition, into all the following respective layers were incorporated appropriate quantities of 1,3,5-triacryloylhexahydro-S-triazine and 1,2-bis(vinylsulfonyl)ethane as hardening agents, saponin as a coating aid, and dextran sulfate as a viscosity-adjusting agent.

Layer 1: Antihalation layer

A black silver halide-containing gelatin solution was coated so that the coated amount of silver is 3 mg/100 $cm^2$ and that of gelatin is 30 mg/100 $cm^2$.

Layer 2: Low-speed red-sensitive photographic emulsion layer

Emulsions I, J and K were separately chemically sensitized and spectrally sensitized by a red-sensitizing dye, and, after that, the Emulsions I and J were mixed in a proportion of 1 to 1 and the mixture was used for Samples 30 and 31, and the Emulsions I and K were mixed in a proportion of 1 to 1 and the mixture was used for Samples 32 and 33.

To the photographic emulsion of Samples 30 and 32 was added a dispersion liquid prepared by protect-dispersing in usual manner a solution of the cyan coupler (C-1), colored cyan coupler (CC-1) of Example-2 and DIR compound (D-14) dissolved into tricresyl phosphate, the addition being made so that the amount of the cyan couplers is 0.094 mole and that of D-14 is $2.5\times10^{-3}$ mole. This emulsion was then coated so that the coated amount of silver is 14 mg/100 $cm^2$ and that of gelatin is 27 mg/100 $cm^2$. To the photographic emulsion of Samples 31 and 33 was added a similar cyan coupler-dispersed liquid containing DIR compound (D-4) in place of the above (D-14) so that the amount of the cyan couplers is 0.094 mole per mole of silver and that of (D-4) is $1.0\times10^{-3}$ mole, and this resulting emulsion was coated in similar manner to the above.

Layer 3: High-speed red-sensitive photographic emulsion layer

The Emulsion D for Samples 30 and 31 and Emulsion E for Samples 32 and 33 were separately chemically sensitized and then spectrally sensitzed by a red-sensitizing dye. To the photographic emulsion of Samples 30 and 32 was added a cyan coupler-dispersed liquid containing (D-14) of Layer-2 so that the amount of the cyan coupler is 0.035 mole per mole of silver and that of (D-14) is $1.5\times10^{-3}$ mole. The resulting emulsion composition was coated so that the coated amount of silver is 14 mg/100 $cm^2$ and that of gelatin is 25 mg/100 $cm^2$. To the emulsion of Samples 31 and 33 was added a cyan coupler-dispersed liquid containing the (D-4) of Layer-2 so that the amount of the cyan coupler is 0.035 mole per mole of silver and that of (D-4) is $7.0\times10^{-4}$ mole, and then the emulsion compositions were coated in like manner.

Layer 4: Interlayer

A gelatin solution was coated so that the coated amount of the gelatin is 13 mg/100 $cm^2$.

Layer 5: Low-speed green-sensitive photographic emulsion

Emulsions I, J and K were separately chemically sensitized and spectrally sensitized by a green-sensitizing dye, and a mixture of the Emulsions I and J mixed in a proportion of 1 to 1 was used for Samples 30 and 31, and another mixture of the Emulsions I and K mixed in a proportion of 1 to 1 was used for Samples 32 and 33. To each of the emulsions of Samples 30 and 32 was added a dispersion liquid (A) prepared by protect-dispersing in usual manner a solution of the foregoing magenta coupler (M-1), colored magenta coupler (CM-1) and DIR compound (D-18) dissolved into tricresyl phosphate so that the amount of the magenta couplers is 0.1 mole per mole of silver and that of (D-18) is $3.2\times10^{-3}$ mole. The thus prepared emulsion compositions each was coated so that the coated amount of silver is 14 mg/100 $cm^2$ and that of gelatin is 29 mg/100 $cm^2$. To each of the emulsions of Samples 31 and 33 was added a same magenta coupler-dispersed liquid as said dispersion liquid (A) except that it contains (D-10) in place of the above (D-18) i.e. dispersion liquid (B) so that the amount of the magenta couplers is 0.1 mole per mole of silver and that of (D-10) is $1.5\times10^{-3}$ mole, and then the emulsion composition each was coated in like manner.

Layer 6: High-speed green-sensitive photographic emulsion layer

Each of the Emulsion D for Samples 30 and 31 and Emulsion E for Samples 32 and 33 was chemically sensitized and spectrally sensitized by a green-sensitizing dye. To each of the emulsions of Samples 30 and 32 was added a magenta coupler-dispersed liquid (A) containing the (D-18) of Layer-5 so that the ammount of the magenta couplers is 0.035 mole per mole of silver that of (D-18) is $1.7\times10^{-3}$ mole, and the resulting compositions each was coated so that the coated amount of silver is 17 mg/100 $cm^2$ and that of gelatin is 25 mg/100 $cm^2$. To each of the emulsions for Samples 31 and 33 was added a magenta coupler-dispersed liquid (B) containing the (D-10) of Layer-5 so that the amount of the magenta couplers is 0.035 mole and that of (D-10) is $8.0\times10^{-4}$ mole, and then the compositions each was coated in like manner.

Layer 7: Interlayer

A gelatin solution was coated so that the coated amount of the gelatin is 13 mg/100 $cm^2$.

Layer 8: Yellow filter layer

An yellow colloidal silver-containing gelatin solution was coated so that the coated amount of silver is 1 mg/100 $cm^2$ and that of the gelatin is 13 mg/100 $cm^2$.

Layer 9: Low-speed blue-sensitive photographic emulsion layer

Emulsions I, J and K were separately chemically sensitized, and then a mixture of the Emulsions I and J mixed in a proportion of 1 to 1 was used for Samples 30 and 31, and a mixture of the Emulsions I and K mixed in a proportion of 1 to 1 was used for Samples 32 and 33. To each of the emulsions for Samples 30 and 32 was added a dispersion liquid prepared by protect-dispersing in usual manner a solution of the following yellow coupler (Y-1) and DIR compound (D-14) dissolved into tricresyl phosphate so that the amount of the yellow coupler is 0.31 mole per mole of silver and that of (D-14) is $3.8\times10^{-3}$ mole, and then the resulting compositions each was coated so that the coated amount of silver is 5 mg/100 $cm^2$ and that of gelatin is 12 mg/100 $cm^2$. To each of the emulsions for Samples 31 and 33 was added an yellow coupler-dispersed liquid containing (D-9) in place of the above (D-14) so that the amount of the yellow coupler is 0.31 mole per mole of silver and that of (D-9) is $1.7\times10^{31\ 3}$ mole, and the resulting composition each was coated in like manner.

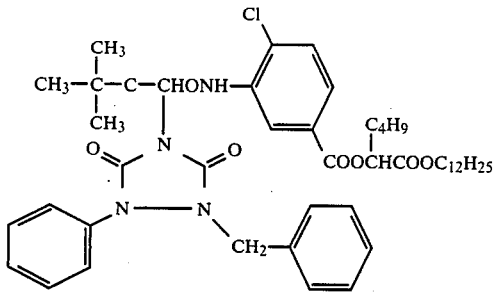

(Y-1)

Layer 10: High-speed blue-sensitive photographic emulsion layer

Each of the Emulsion D for Samples 30 and 31 and Emulsion E for Samples 32 and 33 was chemically sensitized. To each of the emulsions for Samples 30 and 32 was added an yellow coupler-dispersed liquid containing (D-14) of layer 9 so that the amount of the yellow coupler (Y-1) is 0.1 mole per mole of silver and that of (D-16) is $2.2\times10^{-3}$ mole, and the resulting emulsion compositions each was coated so that the coated amount of silver is 5 mg/100 cm$^2$ and that of gelatin is 22 mg/100 cm$^2$. To each of the emulsions for Samples 31 and 33 was added an yellow coupler-dispersed liquid containing the (D-9) of Layer-9 so that the amount of the yellow coupler is 0.1 mole per mole of silver and that of (D-9) is $1\times10^{-3}$ mole, and the resulting compositions each was coated in like manner.

Layer 11: Protective layer

A gelatin solution was coated so that the coated amount of the gelatin is 13 mg/100 cm$^2$.

Each of the thus prepared four different superposedly coated samples was exposed through a square wave chart and a wedge to light, and then processed in the same manner as in Example 1, whereby dye image-formed samples were obtained. The formed color images each was measured with respect to the photographic characteristics, image sharpness and graininess thereof. The measured results are as given in Table 6.

TABLE 6

| Sample | Characteristics of cyan color forming layer | | | | | Characteristics of magenta color forming layer | | | | | Characteristics of yellow color forming layer | | | | |
|---|---|---|---|---|---|---|---|---|---|---|---|---|---|---|---|
| | | | MTF | | | | | MTF | | | | | MTF | | |
| | Speed | Gamma | 10 lines/mm | 30 lines/mm | RMS | Speed | Gamma | 10 lines/mm | 30 lines/mm | RMS | Speed | Gamma | 10 lines/mm | 30 lines/mm | RMS |
| 30 | 100 | 0.58 | 104 | 26 | 28 | 100 | 0.57 | 101 | 43 | 36 | 100 | 0.59 | 95 | 56 | 50 |
| 31 | 101 | 0.59 | 103 | 27 | 30 | 101 | 0.60 | 102 | 45 | 35 | 102 | 0.61 | 96 | 57 | 51 |
| 32 | 98 | 0.55 | 105 | 26 | 29 | 99 | 0.56 | 107 | 46 | 38 | 98 | 0.56 | 100 | 60 | 53 |
| 33* | 101 | 0.58 | 124 | 43 | 18 | 102 | 0.58 | 117 | 60 | 24 | 99 | 0.60 | 110 | 70 | 40 |

Note:
*Sample of the invention

As is apparent from Table 6, the sample of this invention, as in the case of Example-1 or 2, although similar in the speed and gamma to the non-invention samples, is excellent in the graininess and image sharpness as compared to the non-invention samples.

Effect of the Invention

The present invention provides a high-speed color light-sensitive material excellent in the graininess as well as in the image sharpness by way of adding a DIR compound to monodisperse silver bromide emulsion, the said DIR compound having a relative inhibitability with respect to the standard DIR compound having a development inhibitability to a given gradient value as a defined factor, the said monodisperse silver bromide emulsion having a silver iodide content of the core thereof of not less than 8 mole % and a coefficient of variation of the grain size distribution thereof of not more than 0.15.

What is claimed is:

1. A silver halide color photographic light-sensitive material comprising a support having thereon at least one silver halide emulsion layer, wherein at least one of said silver halide emulsion layers includes a group of substantially monodisperse core/shell-type silver halide grains having a value of not greater than 0.15, said value being obtained by dividing a standard deviation value by the average grain size value, wherein said substantially monodisperse core/shell-type silver halide grains have a shell of a thickness of 0.01$\mu$ to 0.1$\mu$ and wherein the silver halide grains contain a silver iodide in the core thereof in an amount of not less than 8 mole % and a silver iodide in the shell thereof in an amount from 0.1 mole % to 6 mole %; and (b) a development inhibitor releasing compound which releases a development inhibitor by the reaction thereof with the oxidized product of a color developing agent and wherein said development inhibiting releasing compound has a relative development inhibitability $\rho s$ of not less than 1, as defined below:

$$\rho s = \frac{\rho}{\rho B} \qquad \rho = 1 - \frac{\gamma i}{\gamma 0}$$

wherein, $\rho$ represents a development inhibitability of the DIR compound to be used; $\gamma i$ represents a gamma value of a color developed silver halide color photographic light-sensitive material containing the aforementioned DIR compound; $\gamma 0$ represents a gamma value of a color developed silver halide color photographic light-sensitive material not containing the DIR compound; $\rho B$ represents a development inhibitability of the following DIR compound $D_B$

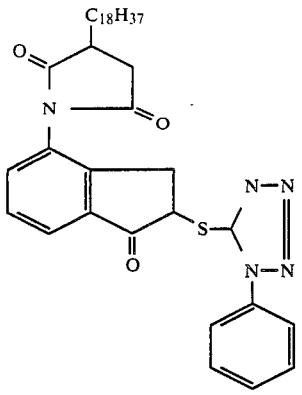

DIR compound $D_B$

2. A silver halide photographic light-sensitive material as claimed in claim 1, wherein said silver halide emulsion layer comprises said development inhibitor releasing compound in an amount of from 0.0001 mole to 0.01 mole per mole of the silver halide thereof.

3. A silver halide photographic light-sensitive material as claimed in claim 1, wherein said relative development inhibitability $\rho s$ is in the range of from 1 to 2.

* * * * *